US009208987B2

(12) United States Patent
Miyazaki et al.

(10) Patent No.: US 9,208,987 B2
(45) Date of Patent: Dec. 8, 2015

(54) RADIOACTIVE RAY GENERATING APPARATUS AND RADIOACTIVE RAY IMAGING SYSTEM

(75) Inventors: Kazuya Miyazaki, Tokyo (JP); Takao Ogura, Yokohama (JP); Kazuyuki Ueda, Tokyo (JP); Yasue Sato, Machida (JP); Ichiro Nomura, Atsugi (JP); Shuji Aoki, Yokohama (JP); Miki Tamura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 315 days.

(21) Appl. No.: 13/580,368

(22) PCT Filed: Feb. 21, 2011

(86) PCT No.: PCT/JP2011/000936

§ 371 (c)(1),
(2), (4) Date: Aug. 21, 2012

(87) PCT Pub. No.: WO2011/105035

PCT Pub. Date: Sep. 1, 2011

(65) Prior Publication Data

US 2012/0318987 A1 Dec. 20, 2012

(30) Foreign Application Priority Data

Feb. 23, 2010 (JP) ..... 2010-037668
Dec. 10, 2010 (JP) ..... 2010-275622
Dec. 14, 2010 (JP) ..... 2010-278363

(51) Int. Cl.
*H01J 35/08* (2006.01)
*H01J 35/16* (2006.01)
*H01J 35/18* (2006.01)

(52) U.S. Cl.
CPC ..... *H01J 35/08* (2013.01); *H01J 35/16* (2013.01); *H01J 35/18* (2013.01); *H01J 2235/068* (2013.01); *H01J 2235/087* (2013.01); *H01J 2235/163* (2013.01); *H01J 2235/166* (2013.01);

(Continued)

(58) Field of Classification Search
CPC ..... H01J 35/00; H01J 35/02; H01J 35/04; H01J 35/06; H01J 35/08; H01J 35/12; H01J 35/16; H01J 35/18; H01J 2235/087; H01J 2235/163; H01J 2235/166; H01J 2235/168
USPC ..... 378/121, 124, 134, 138, 140–142
See application file for complete search history.

(56) References Cited

U.S. PATENT DOCUMENTS 3,124,710 A 3/1964 Gray
3,584,219 A 6/1971 Herglotz et al.

(Continued)

FOREIGN PATENT DOCUMENTS

CN 2242521 Y 12/1996
CN 1925099 A 3/2007

(Continued)

*Primary Examiner* — Robert Kim
*Assistant Examiner* — David E Smith
(74) *Attorney, Agent, or Firm* — Canon USA Inc. IP Division

(57) ABSTRACT

A radioactive ray generating apparatus includes a second shielding member, a target, and a first shielding member, which are sequentially disposed from an electron emission source side. A shortest distance from a maximum radiation intensity portion of the target to the first shielding member is shorter than a shortest distance from the maximum radiation intensity portion of the target to the second shielding member.

20 Claims, 9 Drawing Sheets

(52) U.S. Cl.
CPC ..... *H01J 2235/168* (2013.01); *H01J 2235/186* (2013.01)

(56) References Cited

U.S. PATENT DOCUMENTS

| | | | | |
|---|---|---|---|---|
| 3,767,931 | A | 10/1973 | Williams | |
| 4,048,496 | A * | 9/1977 | Albert | 378/45 |
| 4,121,109 | A | 10/1978 | Taumann et al. | |
| 4,198,570 | A | 4/1980 | McHugh et al. | |
| 7,976,218 | B2 * | 7/2011 | Vermilyea et al. | 378/203 |
| 2005/0025283 | A1 * | 2/2005 | Wilson et al. | 378/124 |
| 2005/0078796 | A1 * | 4/2005 | Leek | 378/119 |
| 2006/0269048 | A1 * | 11/2006 | Cain | 378/142 |
| 2007/0058782 | A1 | 3/2007 | Okada et al. | |
| 2007/0076849 | A1 * | 4/2007 | Bard et al. | 378/121 |
| 2007/0230662 | A1 * | 10/2007 | Imai et al. | 378/130 |
| 2009/0129536 | A1 * | 5/2009 | Ichihara et al. | 378/4 |
| 2009/0129551 | A1 * | 5/2009 | Butler et al. | 378/143 |
| 2009/0232270 | A1 * | 9/2009 | Okunuki et al. | 378/5 |
| 2009/0257551 | A1 * | 10/2009 | Dafni et al. | 378/6 |
| 2009/0316860 | A1 * | 12/2009 | Okunuki et al. | 378/122 |
| 2010/0246766 | A1 * | 9/2010 | Kindlein et al. | 378/65 |
| 2011/0255664 | A1 * | 10/2011 | Ueda et al. | 378/62 |

FOREIGN PATENT DOCUMENTS

| | | | |
|---|---|---|---|
| CN | 101395691 | A | 3/2009 |
| CN | 101494149 | A | 7/2009 |
| CN | 101521135 | A | 9/2009 |
| CN | 101521136 | A | 9/2009 |
| EP | 777255 | A1 * | 6/1997 |
| GB | 762375 | A | 11/1956 |
| JP | 9171788 | A | 6/1997 |
| JP | 2004111336 | A | 4/2004 |
| JP | 2004311245 | A | 11/2004 |
| JP | 2006010335 | A * | 1/2006 |
| JP | 2007265981 | A | 10/2007 |

* cited by examiner

RADIOACTIVE RAY GENERATING APPARATUS AND RADIOACTIVE RAY IMAGING SYSTEM

TECHNICAL FIELD

The present invention relates to a radioactive ray generating apparatus that can irradiate a target with electrons to generate radioactive rays and can be used in an X-ray image capturing operation. Further, the present invention relates to a radioactive ray imaging system that includes the radioactive ray generating apparatus.

BACKGROUND ART

A radioactive ray generating apparatus, which is generally usable as a radiation source, includes an electron emission source that can emit electrons and a radioactive ray generation mechanism that causes generated electrons to collide against a target, which is made of a material having a larger atomic number (e.g., tungsten), to generate radioactive rays. The radioactive ray generated from the target propagates in all directions. Therefore, a shielding member is provided to shield unnecessary radioactive rays that are not available for an image capturing operation. However, if a radioactive ray generating apparatus is configured to include a radioactive ray tube surrounded by a shielding member, downsizing the radioactive ray generating apparatus is difficult.

As a conventional method capable of downsizing the radioactive ray generating apparatus, it is useful to configure the radioactive ray generating apparatus so as to include a transmission-type target because an amount of a shielding material (e.g., lead) to be used to shield unnecessary radioactive rays can be reduced. For example, Japanese Patent Application Laid-Open No. 2007-265981 discusses a structure in which a second shielding member (i.e., a back shielding member) and a first shielding member (i.e., a front shielding member) are provided on both sides of a transmission-type target. According to the structure discussed in Japanese Patent Application Laid-Open No. 2007-265981, an electron beam passes through an aperture of the second shielding member and collides against the target to generate radioactive rays that travel in all directions. The second shielding member can shield radioactive rays emitted toward an electron emission source from the target. Among the radioactive rays which are generated from the target and travel in a direction opposite to the direction of the electron emission source, radioactive rays to be used in an image capturing operation can be extracted from an aperture of the first shielding member. The first shielding member can shield unnecessary radioactive rays. The first and second shielding members are functionally operable as a means capable of releasing heat generated from the target.

Further, as another conventional method capable of downsizing the radioactive ray generating apparatus, it is useful to increase efficiency in generation of radioactive rays to extract an intended amount of radioactive rays with a lesser amount of electric currents. In this method, it is conventionally known that approximately one-half of electrons that have reached a target become reflection electrons and do not contribute to generation of radioactive rays. Therefore, a method capable of effectively reusing the reflection electrons is conventionally discussed. On the other hand, it is conventionally known that reflection electrons may induce generation of radioactive rays from a portion other than a focal point and may electrify constituent components of a radioactive ray tube. To solve the above described issue and improve the efficiency in generation of radioactive rays, a conventional technique discussed in Japanese Patent Application Laid-Open No. H9-171788 uses an electron reflection member that has a channel configured to form an aperture whose diameter decreases with increasing distance from an electron emission source to guide reflection electrons toward a transmission-type target.

CITATION LIST

Patent Literature

PTL 1: Japanese Patent Application Laid-Open No. 2007-265981

PTL 2: Japanese Patent Application Laid-Open No. H9-171788

SUMMARY OF INVENTION

Technical Problem

According to the technique discussed in Japanese Patent Application Laid-Open No. 2007-265981, if a size of the aperture of the second shielding member is equal to or close to a diameter of an electron beam, radioactive rays generated from the target may travel in the backward direction when the electron beam collides against the second shielding member. Therefore, the size of the aperture of the second shielding member is required to be sufficiently greater than the diameter of the electron beam. As a result, a distance between an electron beam irradiation area of the target and the second shielding member is relatively longer. Further, the size of the aperture of the first shielding member is set to be equal to the size of the aperture of the second shielding member. Furthermore, the first shielding member and the second shielding member are located, when the first shielding member and the second shielding member are seen from the electron emission source side, so that the aperture of the first shielding member is overlapped with the aperture of the second shielding member. Therefore, the distance between the electron beam irradiation area of the target and the first shielding member is relatively longer. In other words, heat transfer from the electron beam irradiation area of the target to respective shielding members is delayed. Thus, the heat generated from the target cannot be quickly released and the target may be damaged if irradiation conditions of the electron beam are severe.

According to the technique discussed in Japanese Patent Application Laid-Open No. H9-171788, energy efficiency is insufficient because generation of radiation based on the reuse of electrons reflected by the target is not taken into consideration.

Solution to Problem

The present invention relates to a radioactive ray generating apparatus capable of realizing downsizing of the apparatus body without damaging a target and a radioactive ray imaging system that includes the radioactive ray generating apparatus.

Further, the present invention relates to a radioactive ray generating apparatus which can improve energy efficiency and efficiency in generation of radioactive rays and further can realize downsizing of the apparatus body and a radioactive ray imaging system that includes the radioactive ray generating apparatus.

According to a first aspect of the first invention, a radioactive ray generating apparatus includes an electron emission source, a target that is disposed to face to the electron emission source and is configured to generate radioactive rays by being irradiated with the electrons emitted from the electron emission source, and a shielding member configured to shield the radioactive rays emitted from the target, wherein the shielding member includes a first shielding member and a second shielding member each including an aperture, the second shielding member, the target, and the first shielding member are sequentially disposed in this order from a side adjacent to the electron emission source, the aperture faces to the electron emission source, and a shortest distance from a maximum radiation intensity portion of the target to the first shielding member is shorter than a shortest distance from the maximum radiation intensity portion of the target to the second shielding member.

According to a second aspect of the first invention, a radioactive ray generating apparatus includes an electron emission source, a target that is disposed to face to the electron emission source and is configured to generate radioactive rays by being irradiated with the electrons emitted from the electron emission source, and a shielding member configured to shield the radioactive rays emitted from the target, wherein the shielding member includes a first shielding member and a second shielding member each including an aperture, the second shielding member, the target, and the first shielding member are sequentially disposed in this order from a side adjacent to the electron emission source, the aperture faces to the electron emission source, and a shortest distance from a centroid of a shape of a target side aperture edge of the second shielding member to the first shielding member is shorter than a shortest distance from the centroid of the shape of the target side aperture edge of the second shielding member to the second shielding member.

According to a first aspect of the second invention, a radioactive ray generating apparatus includes an electron emission source, a target configured to generate, from an incidence surface that receives electrons emitted from the electron emission source, reflection electrons of the electrons and to emit radioactive rays from another surface facing to the incidence surface, and an electron reflection member configured to reflect the reflection electrons toward the target if the reflection electrons collide against the electron reflection member.

According to a second aspect of the second invention, a radioactive ray generating apparatus includes an electron emission source, a target configured to generate, from an incidence surface that receives electrons emitted from the electron emission source, reflection electrons of the electrons and to emit radioactive rays from another surface facing to the incidence surface, a radiation shielding member that is bonded to the incidence surface, has an aperture which has a truncated cone shape and an upper surface positioned on the incidence surface of the target, and configured to regulates an electron incidence area of the target by the upper surface, and an electron reflection member configured to reflect the reflection electrons toward the target if the reflection electrons collide against the electron reflection member.

Advantageous Effects of Invention

According to the first invention, heat generated when an electron beam collides against the target can be quickly released to the first shielding member. The heat can be subsequently released to the second shielding member. Therefore, the generated heat can be effectively released, and the heat load of the target can be reduced. Thus, the radioactive ray generating apparatus which is excellent in heat resistance and does not damage the target can be realized. Further, the radioactive ray generating apparatus can be downsized if a transmission-type target is employed for the radioactive ray generating apparatus.

According to the second invention, the efficiency in generation of radioactive rays can be improved because reflection electrons are appropriately guided toward the target again after the reflection electrons are generated from the target on which the radioactive rays are generated. Accordingly, the radioactive ray generating apparatus according to the second invention can lower the heat load of the target because the amount of electric currents to be required to obtain a predetermined dose of radioactive rays is relatively small. Thus, the radioactive ray generating apparatus which is excellent in energy efficiency and in efficiency in generation of radioactive rays can be realized. Further, the radioactive ray generating apparatus can be downsized if a transmission-type target is employed for the radioactive ray generating apparatus.

Further features and aspects of the present invention will become apparent from the following detailed description of exemplary embodiments with reference to the attached drawings.

BRIEF DESCRIPTION OF DRAWINGS

The accompanying drawings, which are incorporated in and constitute a part of the specification, illustrate exemplary embodiments, features, and aspects of the invention and, together with the description, serve to explain the principles of the invention.

DESCRIPTION OF EMBODIMENTS

Various exemplary embodiments, features, and aspects of the invention will be described in detail below with reference to the drawings.

Exemplary Embodiment of the First Invention

An example radioactive ray generating apparatus according to exemplary embodiments of a first invention is described below with reference to attached drawings. However, materials, dimensions, shapes, and relative layout of constituent components described in the following exemplary embodiments are mere examples and are not intended to narrowly interpret the scope of the present invention unless they are mentioned specifically.

First Exemplary Embodiment

Figure 1:
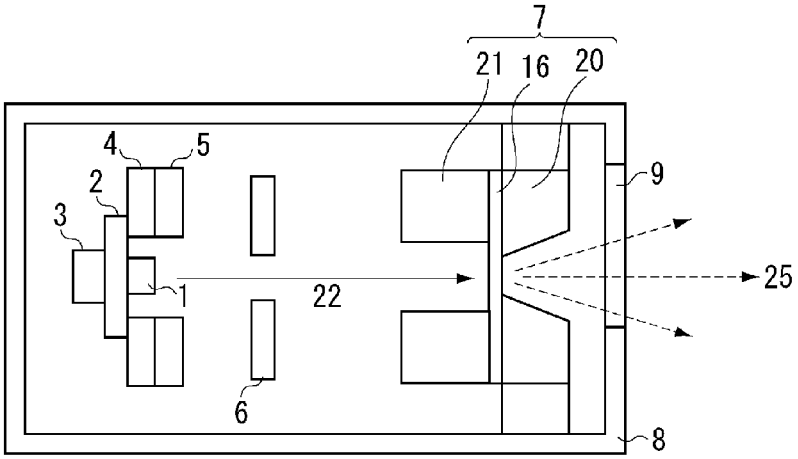
FIG. 1 illustrates a cross-sectional configuration of a radioactive ray generating apparatus according to a first exemplary embodiment of the first invention.

An example configuration of the radioactive ray generating apparatus according to a first exemplary embodiment of the first invention is described below. FIG. 1 is a cross-sectional view illustrating an example configuration of the radioactive ray generating apparatus according to the present exemplary embodiment.

The radioactive ray generating apparatus according to the present exemplary embodiment includes an electron emission source 1, a target 16, and a shielding member. The target 16 is disposed to face the electron emission source 1 and generates radioactive rays by being irradiated with electrons emitted from the electron emission source 1. The shielding member can shield radioactive rays emitted from the target 16. The target 16 and the shielding member including a first shielding member 20 and a second shielding member 21 cooperatively constitute an anode 7. In the example radioactive ray generating apparatus according to the present exemplary embodiment, the electron emission source 1, the target 16, and the shielding member are provided in an envelope 8 (i.e., in a vacuum chamber). A heater 3, a grid electrode 4, a grid electrode support member 5, and a focusing electrode 6 may be provided, as illustrated in FIG. 1, as a mechanism that can irradiate the target 16 with electrons emitted from the electron emission source 1.

The electron emission source 1 can emit electrons. Either a cold cathode or a hot cathode can be used as a cathode of the electron emission source 1. However, when the electron emission source is incorporated in the radioactive ray generating apparatus, it is desired to use an impregnated cathode (hot cathode) because large electric current can be stably extracted even in an environment where the degree of vacuum is relatively high. The electron emission source 1 is integrated with an insulation member 2.

The heater 3 is positioned in the vicinity of the cathode. When electric power is supplied to the heater 3, temperature of the cathode rises and electrons are emitted from the cathode.

The grid electrode 4 is an electrode to which a predetermined voltage is applied to extract electrons generated from the electron emission source 1 (i.e., the cathode) into a vacuum. The grid electrode 4 and the electron emission source 1 are spaced from each other with a predetermined distance between them. To realize the above-described layout, the insulation member 2 is integrated with the electron emission source 1 and is positioned to abut against the grid electrode support member 5. The grid electrode 4 is spaced from the cathode via a predetermined clearance (e.g., several hundred micrometers) due to the intervention of the grid electrode support member 5. The grid electrode 4 has a shape, a bore diameter, and an aperture ratio that can be determined considering exhaust conductance in the vicinity of the cathode to let the electric current efficiently reach the target. For example, a tungsten mesh having a wire diameter of approximately 50 micrometer can be used to form the grid electrode 4.

The focusing electrode 6 is provided to control a focal diameter of an electron beam on a target plane when the grid electrode 4 extracts electrons from the cathode. The focal diameter determines a circular focus area on the target plane. It is usual that a voltage of several hundred volts to several thousand volts is applied to the focusing electrode 6 to adjust the focal diameter. Alternatively, the focusing electrode 6 can be omitted if an appropriate lens effect capable of focusing the electron beam can be realized by applying a predetermined voltage to the grid electrode support member 5.

As described above, the anode 7 includes the target 16 and the shielding member. The shielding member has an aperture and includes the first shielding member 20 and the second shielding member 21. The second shielding member 21, the target 16, and the first shielding member 20 are sequentially disposed in this order from the electron emission source side. Apertures of the respective shielding members face to the electron emission source 1. A voltage in a range from 30 kV to 150 kV is applicable to the target 16. When an electron beam 22 is generated by the electron emission source 1, the electron beam 22 is extracted by the grid electrode 4. Then, the electron beam 22 is directed toward an electron beam irradiation area of the target 16 by the focusing electrode 6 and is accelerated by the voltage applied to the target 16. Then, radioactive rays 25 are generated when the electron beam 22 collides against the target 16. A position and driving conditions of the electron emission source 1 can be controlled to coincide the electron beam irradiation area (i.e., a focus area) with a central portion of the target 16. Thus, the focal point can be positioned at the central portion of the target 16. The radioactive rays generated from the target 16 can be extracted to the outside of the envelope 8 via a radiation transmission window 9 and can be used for an image capturing operation.

Figure 2:
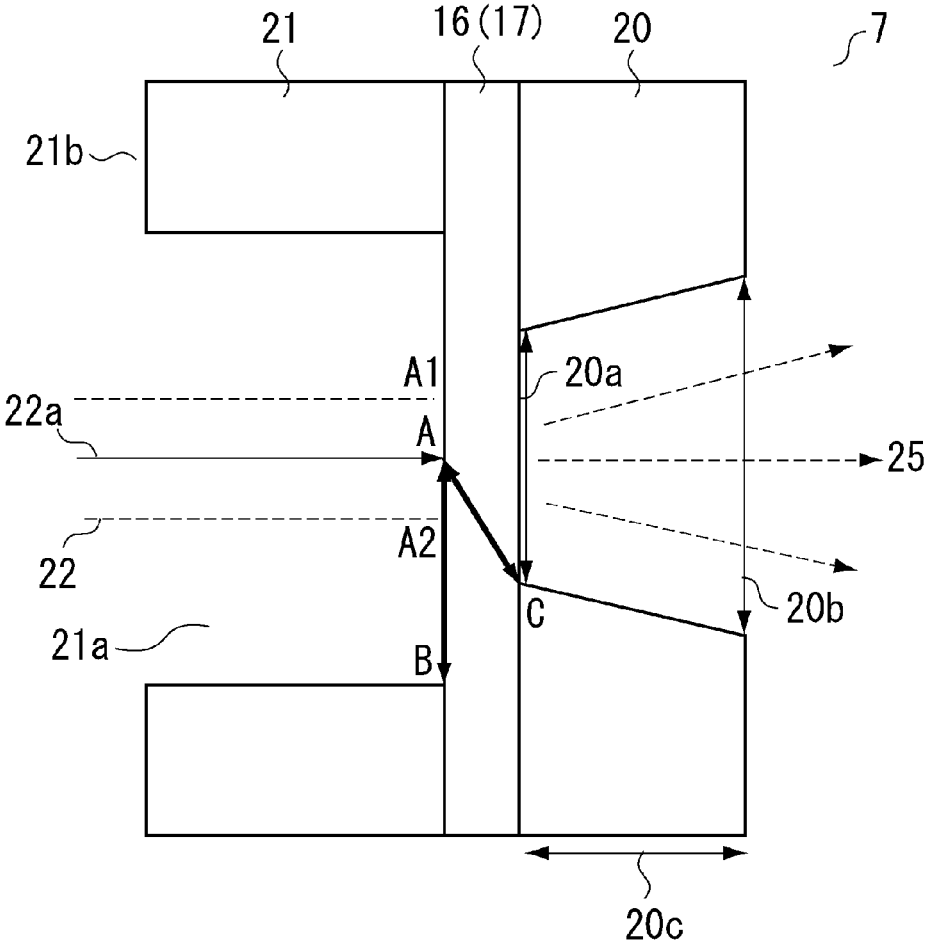
FIG. 2 illustrates a cross-sectional configuration of an anode according to the first exemplary embodiment of the first invention.

The target 16, the first shielding member 20, and the second shielding member 21, which cooperatively constitute the anode 7, are described in more detail with reference to FIG. 2. FIG. 2 is a cross-sectional view illustrating an example configuration of the anode 7 according to the present exemplary embodiment.

The target 16 includes only a target film 17. Usually, a metallic material having an atomic number equal to or greater than 26 can be used to constitute the target 16. For example, a material that is excellent in heat conductivity and has a larger specific heat can be preferably used. For example, a thin film using a metallic material, such as tungsten, molybdenum, chromium, copper, cobalt, iron, rhodium, or rhenium, or its alloy material can be preferably used as the material of the target 16, because the heat generated from the electron beam irradiation area of the target 16 can be quickly transferred to the entire region of the first shielding member 20. The generated radioactive rays are required to transmit the target film 17. Therefore, a film thickness of the target film 17 is in a range from 1 micrometer to 15 micrometer, although an optimum thickness of the target film 17 is variable because an electron beam penetration depth (i.e., a radiation generation area) generally depends on acceleration voltage.

The first shielding member 20 has a function of extracting a necessary part of radioactive rays via its aperture and of shielding the rest of unnecessary radioactive rays in a case where the radioactive rays from the target 16 travel in the forward direction (i.e., in such a way as to depart from the electron emission source side). Any material capable of shielding radioactive rays generated at a voltage of 30 kV to 150 kV can be used as a material that forms the first shielding member 20. It is desired that a material to be used as the first shielding member 20 has a higher radiation absorption rate and is excellent in heat conductivity. More preferably, if the target 16 is made of tungsten, it is desired to use a material containing tungsten, tantalum, or its alloy to form the first shielding member 20. If the target 16 is made of molybdenum, it is desired to use a material containing tungsten, tantalum, molybdenum, zirconium, or niobium to form the first shielding member 20.

The aperture shape of the first shielding member 20 can be a circular shape or a rectangular shape. The size of the aperture of the first shielding member 20 is required to be sufficiently large to extract a necessary amount of radioactive rays. If the aperture shape is a circular shape, a preferable diameter of the aperture is in a range from 0.1 mm to 3 mm. If the aperture shape is a rectangular shape, it is desired that one side of the rectangular aperture is in a range from 0.1 mm to 3 mm. When the aperture size is equal to or less than 0.1 mm, the amount of radioactive rays that can be substantially used in an image capturing operation becomes smaller. When the aperture size is equal to or greater than 3 mm, the amount of heat that can be substantially released to the first shielding member 20 becomes smaller.

Further, it is desired that the aperture of the first shielding member 20 gradually expands with increasing distance from the electron emission source side. More specifically, it is desired that the aperture of the first shielding member 20 gradually expands toward an opposite to the target side aperture edge 20*b* from the target side aperture edge 20*a*. Narrowing the target side aperture edge 20*a* is effective in that the heat generated from the target 16 can be quickly released to the first shielding member 20 as described below. Further, widening the aperture edge 20*b* opposite to the target side is effective in that a wider irradiation area of radioactive rays is available in an image capturing operation.

The first shielding member has a thickness 20*c* that can assure a shielding effect capable of sufficiently reducing the generated radiation to a safe level. An appropriate size of the thickness 20*c* is variable depending on the energy level of radioactive rays to be generated. For example, if the energy level of radioactive rays to be generated is in a range from 30 keV to 150 keV, the required size of the thickness 20*c* is at least in a range from 1 mm to 3 mm even when the first shielding member 20 is made of tungsten a material having a large shielding effect. From the viewpoint of sufficiently shielding radioactive rays, it is desired that the thickness of the first shielding member 20 is greater than 3 mm. Further, from the viewpoint of heat capacity, cost, and weight, it is desired that the thickness of the first shielding member 20 is in a range from 3 mm to 10 mm.

The second shielding member 21 has a function capable of shielding radioactive rays that travel from the target 16 in the backward direction (i.e., toward the electron emission source side) and a function capable of guiding the electron beam 22 to pass through the aperture and reach the target 16. However, the radioactive rays having passed through the aperture 21*a* of the second shielding member 21 and traveling in the direction opposite to the electron emission source side cannot be shielded. Therefore, providing an independent shielding device is useful. A material usable to form the second shielding member 21 is similar to that of the first shielding member 20. The material of the first shielding member 20 can be identical or different from the material of the second shielding member 21.

The aperture 21*a* of the second shielding member 21 is required to be large enough to enable at least the electron beam 22 to pass through the aperture 21*a*. If the size of the aperture 21*a* of the second shielding member 21 is larger than, or is very close to, the diameter of the electron beam 22, at least a part of the electron beam 22 collides with an electron emission source side 21*b* of the second shielding member 21. An irradiation area of the electron emission source side 21*b* of the second shielding member 21 generates radioactive rays. As a result, a shielding function of the second shielding member 21 becomes extremely smaller. Therefore, the required size of the aperture 21*a* of the second shielding member 21 is large enough to enable at least the electron beam 22 to pass through the aperture 21*a* and prevent a part of the electron beam 22 from colliding with the electron emission source side 21*b* of the second shielding member 21. A desirable size of the aperture 21*a* of the second shielding member 21 is not a fixed value because a focusing state of the electron beam 22 is variable depending on the type of the electron emission source or a type of the focusing electrode. It is desired that a distance from the electron beam irradiation area of the target 16 to the second shielding member 21 is approximately equal to or greater than 1 mm.

It is desired that the aperture 21*a* of the second shielding member 21 has a circular shape or a regular polygonal shape. In general, the electron beam 22 is circular or rectangular in its cross-sectional shape. Therefore, the aperture 21*a* having the above-described shape is useful because a constant distance can be maintained between the electron beam irradiation area of the target 16 and the second shielding member 21.

Similar to the thickness 20*c* of the first shielding member 20, it is feasible to obtain a desired thickness of the second shielding member 21. However, the thickness of the second shielding member 21 is not required to be identical to the thickness 20*c* of the first shielding member 20. However, in order to sufficiently shield radioactive rays, it is desired that the thickness of the second shielding member 21 is in a range from 3 mm to 10 mm, as similar to that of the thickness 20*c* of the first shielding member 20.

In the present exemplary embodiment, effects of the first invention can be obtained if any one of the following two configurations is employed for the above-described anode 7 which is composed of the target 16, the first shielding member 20, and the second shielding member 21.

The first configuration employable for the anode 7 is characterized in that a shortest distance from a maximum radiation intensity portion of the target 16 to the first shielding member 20 is shorter than a shortest distance from the maximum radiation intensity portion of the target 16 to the second shielding member 21. Following is the reason why employing the above-described first configuration for the anode 7 is desired.

If the electron beam 22 collides with the target 16, the electron beam irradiation area of the target 16 generates radioactive rays 25. Heat is generated from the electron beam irradiation area, and the temperature of the target 16 increases. The temperature tends to increase greatly at a portion where the intensity of generated radioactive rays is high (i.e., the amount of radiation is large). More specifically, a portion where the temperature becomes highest coincides with a portion where the radiation intensity is maximized According to the above-described first configuration, the first shielding member 20 is positioned closer to the maximum radiation intensity portion than the second shielding member 21. Thus, the heat from the highest temperature portion of the target 16 can be released quicker. First, the heat can be transferred to the first shielding member 20, and then further transferred to the second shielding member 21. Accordingly, the above-described first configuration for the anode 7 can effectively release the heat from the target 16 without damaging the target 16. A conventional technique can be employed to measure the intensity of radioactive rays.

The second configuration employable for the anode 7 is characterized in that a shortest distance from a centroid of a shape of a target side aperture edge of the second shielding member 21 to the first shielding member 20 is shorter than a shortest distance from the centroid of the shape of the target side aperture edge of the second shielding member 21 to the second shielding member 21. Following is the reason why employing the above-described first configuration for the anode 7 is desired.

FIG. 2 is a cross-sectional view illustrating the anode 7 that employs the above-described second configuration. In FIG. 2, a line segment A1-A2 represents a cross section of the electron beam irradiation area of the target 16 and a point A represents the center of the electron beam irradiation area of the target 16. A center 22*a* of the electron beam 22 collides with the central point A of the electron beam irradiation area of the target 16. The central point A of the electron beam irradiation area of the target 16 coincides with the centroid of the shape of the target side aperture edge of the second shielding member 21, when they are seen from the electron emission source side. The above-described design is useful to cause the incident electron beam 22 to surely reach the target 16 and extract a required amount of radioactive rays 25. A point B of the second shielding member 21 represents a portion where the distance from the point A is shortest. A point C of the first shielding member 20 represents a point where the distance from the point A is shortest. The distance A-C is shorter than the distance A-B. Further, it is usual that the central point A of the electron beam irradiation area of the target 16 is a portion where the radiation intensity is maximized and the temperature becomes highest. As described above, according to the above-described second configuration, the first shielding member 20 is positioned closer to the centroid of the shape of the target side aperture edge of the second shielding member 21, i.e., the central point A of the electron beam irradiation area of the target 16. Therefore, the heat can be quickly released from the highest temperature portion of the target 16. First, the heat can be transferred to the first shielding member 20, and then further transferred to the second shielding member 21. Accordingly, the above-described first configuration for the anode 7 can effectively release the heat from the target 16 without damaging the target 16.

Further, according the above-described second configuration, the shape of the target side aperture edge 20*a* of the first shielding member 20 can be configured to be involved in the shape of the target side aperture edge of the second shielding member 21, when they are seen from the electron emission source side. In this case, the heat can be quickly transferred from the highest temperature portion of the target 16 to the entire periphery of the target side aperture edge 20*a* of the first shielding member 20. Therefore, the above-described configuration is desired in that the heat can be effectively released.

Further, according to the above-described second configuration, the centroid of the shape of the target side aperture edge 20*a* of the first shielding member 20 can be configured to coincide with the centroid of the shape of the target side aperture edge of the second shielding member 21, when seen from the electron emission source side. In this case, a required amount of radioactive rays can be surely extracted. The above-described configuration is applicable to the above-described arrangement that the shape of the target side aperture edge 20*a* of the first shielding member 20 is configured to be involved in the shape of the target side aperture edge of the second shielding member 21, when they are seen from the electron emission source side.

Figure 3:
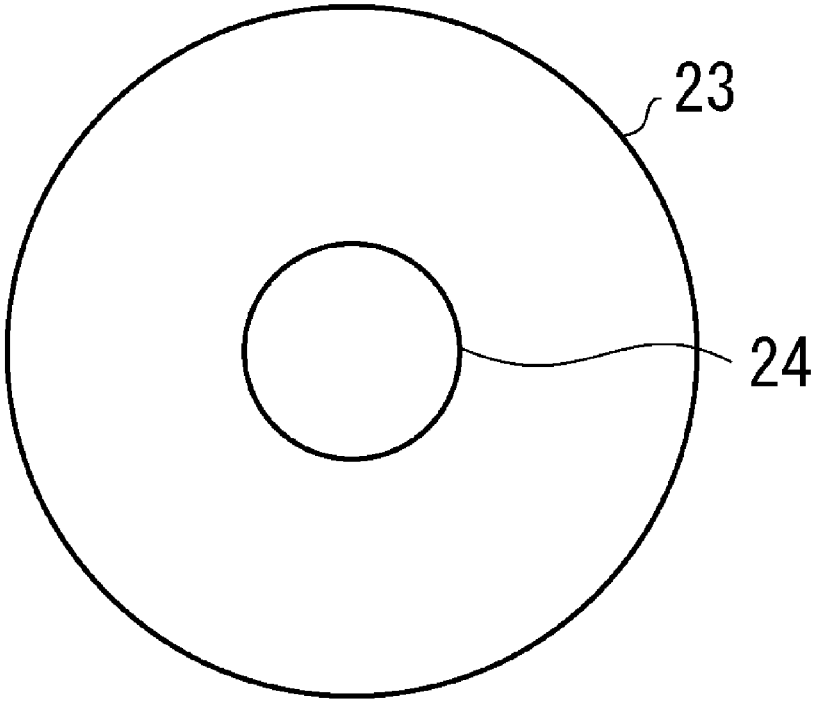
FIG. 3 illustrates a positional relationship between a focal point of radioactive rays and a first shielding member according to the first invention.

A radiation sensor with a pinhole can be used to measure the positional relationship between the electron beam irradiation area of the target 16 and the first shielding member 20. FIG. 3 illustrates an example positional relationship between the focal point of radioactive rays and the first shielding member 20, which has been measured with the radiation sensor. In FIG. 3, a central circle 24 represents the focal point of the radioactive rays emitted from the target 16 and an external circle 23 represents the aperture of the first shielding member 20. No radioactive rays can be generated from a region between the central circle 24 and the external circle 23. If the diameter of the electron beam 22 is increased while changing conditions of the electron emission source 1 and the focusing electrode 6, the size of the central circle 24 becomes greater and reaches a size comparable to the external circle 23. This method can be used to determine the positional relationship between the electron beam irradiation area of the target 16 and the first shielding member 20. The positional relationship between the electron beam irradiation area of the target 16 and the first shielding member 20 can be obtained because the positional relationship between the first shielding member 20 and the second shielding member 21 is apparent.

Figure 4A:
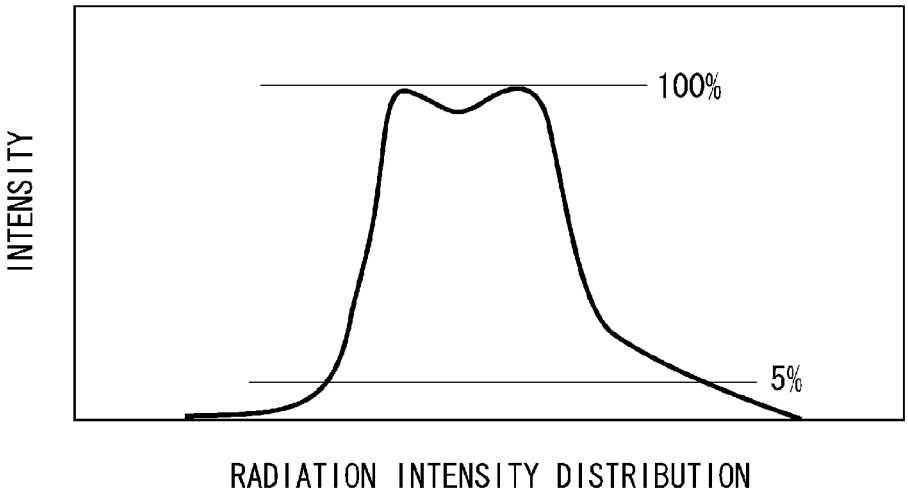
FIG. 4A illustrates an example of a radiation intensity distribution on a target according to the first invention.
Figure 4B:
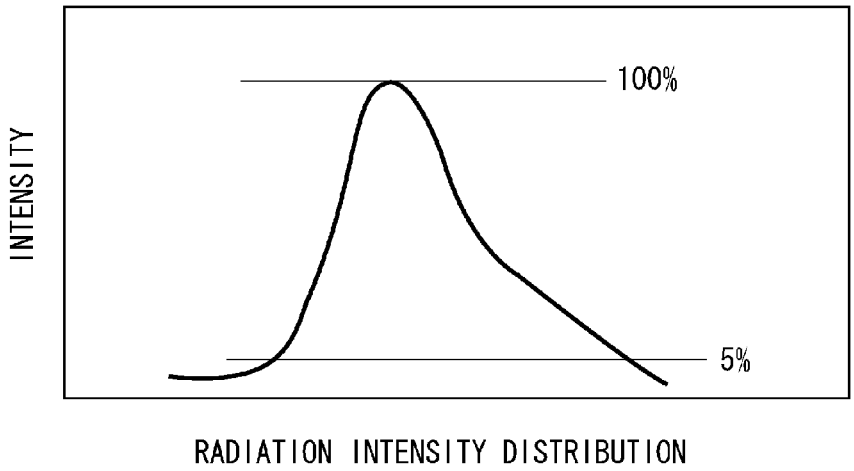
FIG. 4B illustrates an example of a radiation intensity distribution on a target according to the first invention.

The focal point of radioactive rays can be defined by measuring a radiation intensity distribution on the target 16. FIGS. 4A and 4B illustrate examples of the radiation intensity distribution on the target 16, which can be measured using a conventional technique. FIG. 4A illustrates an example of the radiation intensity distribution, according to which the radiation intensity is maximized at two portions. FIG. 4B illustrates another example of the radiation intensity distribution, according to which the radiation intensity is maximized at only one portion. In any case, when the maximum intensity is 100%, an area in which the radiation intensity is equal to or greater than 5% can be defined as a focal point. In the example illustrated in FIG. 4A, the position corresponding to a minimum value between two portions where the intensity is maximized (100%) can be defined as the center of the focal point. In the example illustrated in FIG. 4B, the position where the intensity is maximized (100%) can be defined as the center of the focal point.

Brazing, mechanical pressing, and thread fastening can be employed to connect the first shielding member 20, the target 16, and the second shielding member 21 together.

Second Exemplary Embodiment

Figure 5:
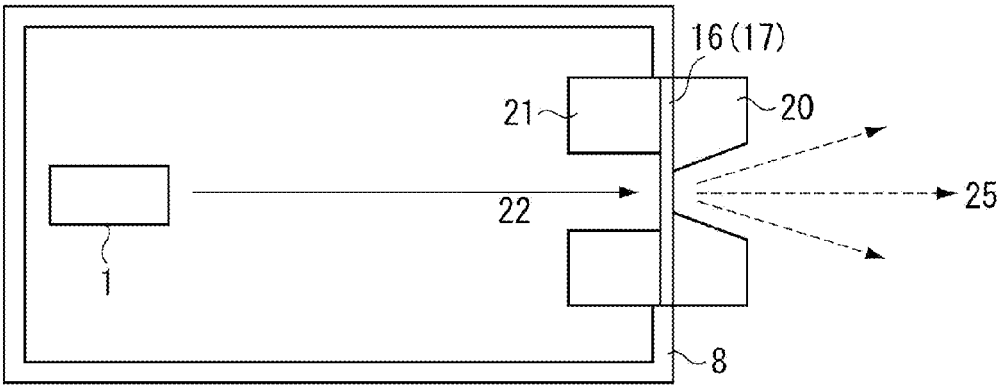
FIG. 5 illustrates a cross-sectional configuration of a radioactive ray generating apparatus according to a second exemplary embodiment of the first invention.

A configuration of a radioactive ray generating apparatus according to a second exemplary embodiment of the first invention is described below. FIG. 5 is a cross-sectional view illustrating an example configuration of the radioactive ray generating apparatus according to the present exemplary embodiment.

The radioactive ray generating apparatus according to the present exemplary embodiment is similar to the radioactive ray generating apparatus described in the first exemplary embodiment of the first invention, except that the target 16 functions as a vacuum sealing member and a radiation extraction window and at least a part of the first shielding member 20 is kept in contact with a cooling medium (not illustrated), as illustrated in FIG. 5. Although the configuration illustrated in FIG. 5 does not include a heater, a grid electrode, a grid electrode support member, and a focusing electrode, the radioactive ray generating apparatus may include the heater 3, the grid electrode 4, the grid electrode support member 5, and the focusing electrode 6 illustrated in FIG. 1. Each constituent component is similar to that described in the first exemplary embodiment of the first invention and therefore the description thereof is not repeated.

In the present exemplary embodiment, similar to the first exemplary embodiment of the first invention, the heat generated from the electron beam irradiation area of the target 16 can be quickly transferred to the first shielding member 20. As at least a part of the first shielding member 20 is kept in contact with the cooling medium, the heat transferred to the first shielding member 20 can be further transferred from the first shielding member 20 to the cooling medium. Thus, the cooling medium positioned in contact with the first shielding member 20 can enhance the heat releasing effect. Further, as the target 16 is also kept in contact with the cooling medium, the heat generated from the electron beam irradiation area of the target 16 can be transferred to the cooling medium from another side opposite to the electron beam irradiation area of the target 16 (i.e., the surface being kept in contact with the cooling medium). Therefore, the heat releasing effect can be further enhanced. Air and electric insulation oil are preferable examples of the cooling medium. Both air and electric insulation oil are inferior to the first shielding member 20 and the second shielding member 21 in heat conduction. However, compared to the above-described case where the target 16 and the first shielding member 20 are placed in a vacuum chamber as described in the first exemplary embodiment of the first invention, a heat-releasing effect based on convection of air or electric insulation oil is available. Therefore, the radioactive ray generating apparatus according to the present exemplary embodiment can cool the target 16 more efficiently than that of the first exemplary embodiment of the first invention.

Brazing or laser welding, in addition to thermal connection, can be employed to connect the target 16 and the first shielding member 20 together so as to appropriately maintain that vacuum.

Third Exemplary Embodiment

Figure 6:
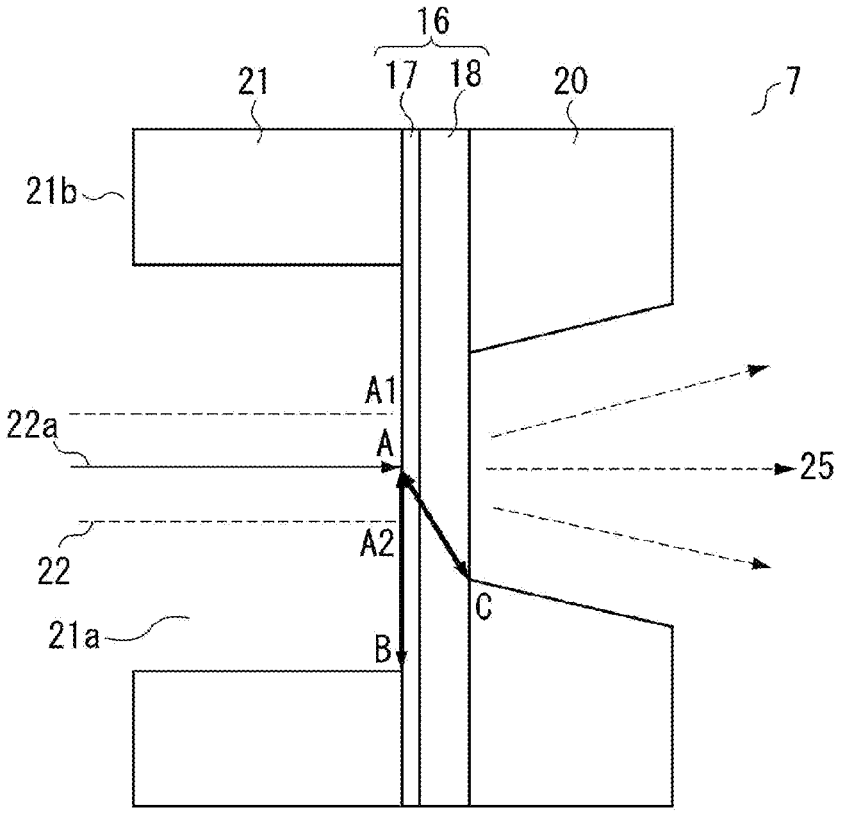
FIG. 6 illustrates a cross-sectional configuration of an anode according to a third exemplary embodiment of the first invention.

An example of the anode 7 according to a third exemplary embodiment of the first invention is described below in more detail. FIG. 6 is a cross-sectional view illustrating an example configuration of the anode 7 according to the third exemplary embodiment.

A radioactive ray generating apparatus according to the present exemplary embodiment is characterized in that the target 16 includes a transmissive substrate 18 and a target film 17 as illustrated in FIG. 6. The transmissive substrate 18 is a member through which radioactive rays can be transmitted. The target film 17 is disposed on the electron emission source side of the transmissive substrate 18. Any other type of target 16 can be used if it includes members that are functionally operable as the transmissive substrate 18 that can transmit radioactive rays and the target film 17 provided on the electron emission source side of the transmissive substrate 18. The rest of the members illustrated in FIG. 6 are similar to those described in the first exemplary embodiment of the first invention and therefore the descriptions thereof are not repeated.

To enable radioactive rays to pass through the target film 17, a desired thickness of the target film 17 is equal to or less than 15 micrometer. However, if the transmissive substrate 18 is not provided as described in the first exemplary embodiment or the second exemplary embodiment of the first invention, the temperature of the target film 17 becomes higher and may melt because the heat capacity obtainable when the target film 17 has the above-described thickness is insufficient. Accordingly, it is difficult to input a large amount of energy. In particular, if only the target film 17 is used to seal the vacuum chamber, the target film 17 may be broken. From the above-described reasons, providing the transmissive substrate 18 is useful to input a large amount of energy.

The transmissive substrate 18 is required to be excellent not only in radiation transmissivity but also in heat conductivity. The transmissive substrate 18 is further required to be rigid enough to seal the vacuum chamber. For example, a member containing diamond, silicon nitride, silicon carbide, aluminum carbide, aluminum nitride, graphite, or beryllium is usable to constitute the transmissive substrate 18. More specifically, using a transmissive substrate containing diamond, aluminum nitride, or silicon nitride is preferable because the radiation transmissivity thereof is smaller compared to that of aluminum and the heat conductivity thereof is greater compared to that of tungsten. The transmissive substrate 18 can be any thickness as long as the above-described functions can be satisfied. A desired thickness of the transmissive substrate 18 is in a range from 0.1 mm to 2 mm, although it is useful to set an optimum thickness for each material. In particular, compared to other materials, diamond is extremely excellent in heat conductivity and radiation transmissivity and further rigid enough to seal the vacuum chamber.

The target 16 according to the present exemplary embodiment can be manufactured in the following manner. For example, the target film 17 can be obtained by spattering or vaporizing a target material onto the transmissive substrate 18. Alternatively, the target film 17 having a predetermined thickness can be fabricated beforehand by rolling or grinding a target material. Then, the target film 17 can be integrated with the transmissive substrate 18 by diffusion bonding, which is performed in a higher-voltage and high-temperature environment.

Further, the target 16 according to the present exemplary embodiment can be applied to the radioactive ray generating apparatus described in the first exemplary embodiment or the second exemplary embodiment of the first invention. In particular, the target 16 according to the present exemplary embodiment can effectively maintain a vacuum when the target 16 is employed for the radioactive ray generating apparatus in the second exemplary embodiment of the first invention.

Fourth Exemplary Embodiment

Figure 7:
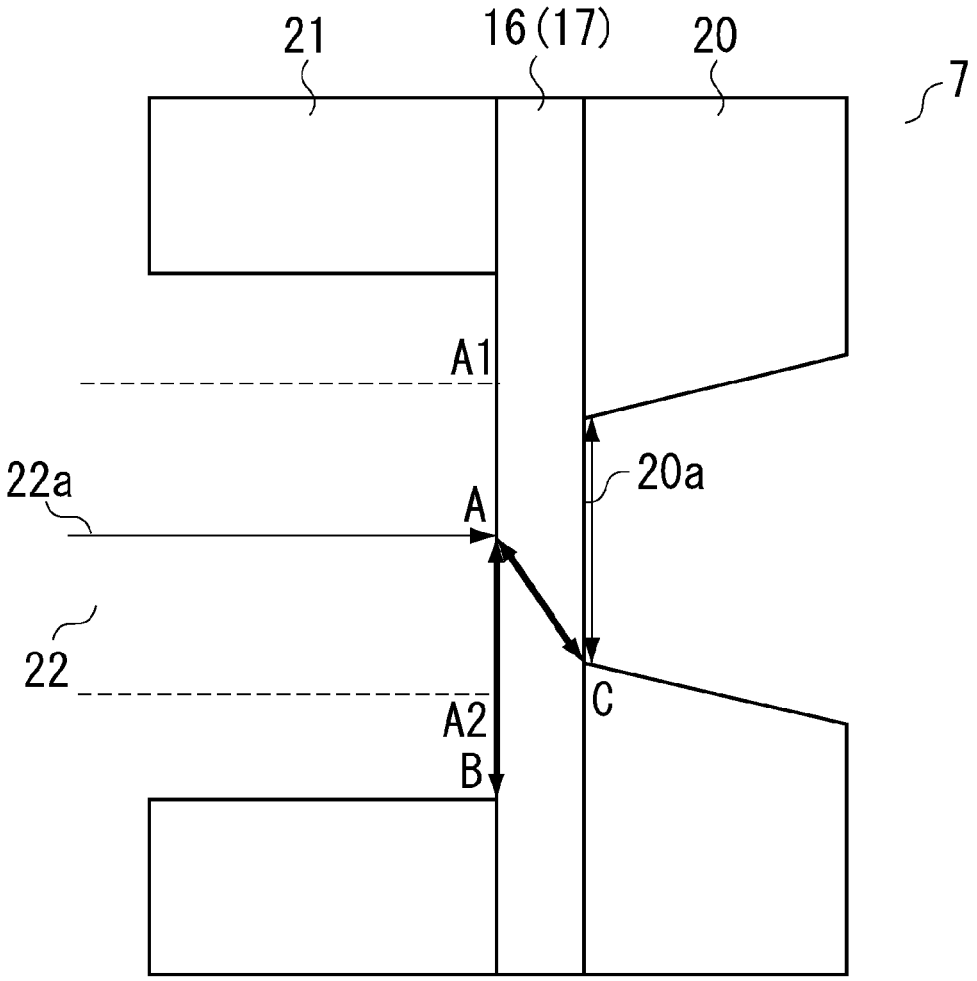
FIG. 7 illustrates a cross-sectional configuration of an anode according to a fourth exemplary embodiment of the first invention.

An example of the anode 7 according to a fourth exemplary embodiment of the first invention is described below in more detail. FIG. 7 is a cross-sectional view illustrating an example configuration of the anode 7 according to the fourth exemplary embodiment.

A radioactive ray generating apparatus according to the present exemplary embodiment is characterized in that the size of the target side aperture edge 20*a* of the first shielding member 20 is smaller than the width A1-A2 of the electron beam irradiation area of the target 16, as illustrated in FIG. 7. The rest of the members illustrated in FIG. 7 are similar to those described in the first exemplary embodiment of the first invention and therefore the descriptions thereof are not repeated.

The anode 7 according to the present exemplary embodiment can be applied to the radioactive ray generating apparatus described in the first exemplary embodiment or the second exemplary embodiment of the first invention. Employing the above-described configuration is useful to reduce the distance between the entire periphery of the target side aperture edge 20*a* of the first shielding member 20 and the highest temperature portion of the target 16. Accordingly, similar to the first exemplary embodiment or the second exemplary embodiment of the first invention, the heat generated from the highest temperature portion of the target 16 can be quickly transferred to the entire periphery of the target side aperture edge 20*a* of the first shielding member 20. Therefore, the heat releasing effect can be further enhanced. Further, the target side aperture edge 20*a* of the first shielding member 20 can function as a collimator, so that it is desirable when the focal diameter is small. The target 16 described in the third exemplary embodiment of the first invention can be used as the target 16 of the present exemplary embodiment.

Fifth Exemplary Embodiment

Figure 8:
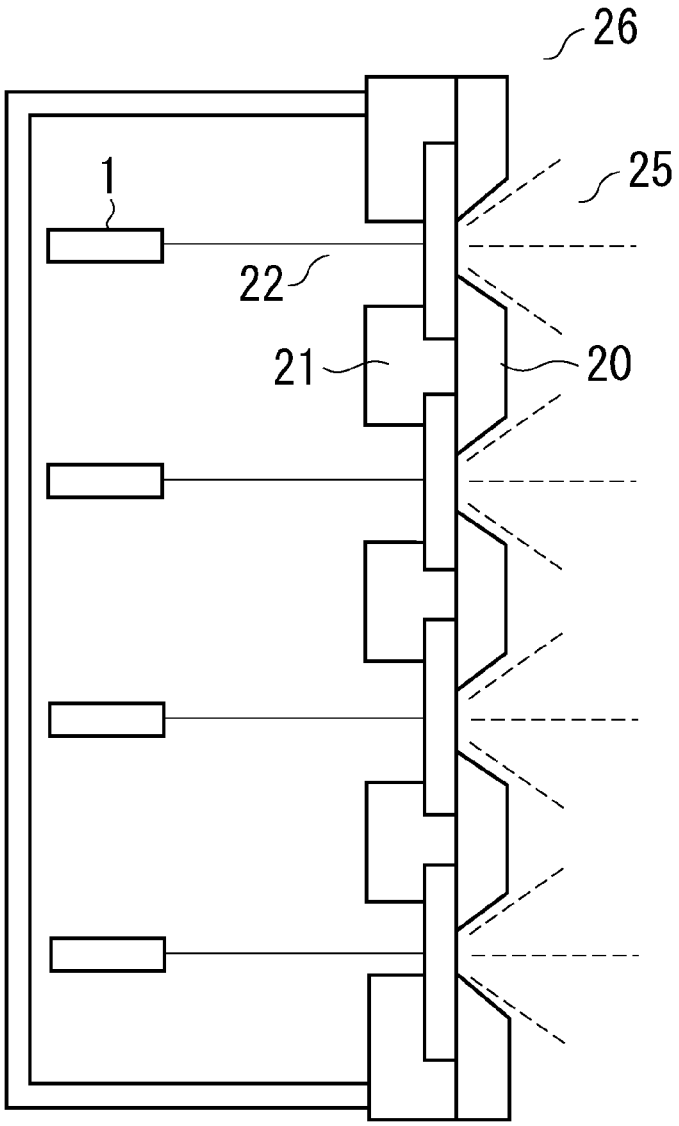
FIG. 8 illustrates a cross-sectional configuration of a radioactive ray generating apparatus according to a fifth exemplary embodiment of the first invention.

A configuration of a radioactive ray generating apparatus according to a fifth exemplary embodiment of the first invention is described below. FIG. 8 is a cross-sectional view illustrating an example configuration of the radioactive ray generating apparatus according to the present exemplary embodiment.

The radioactive ray generating apparatus according to the present exemplary embodiment is a multiple-type radioactive ray generating apparatus 26, which includes an assembly of a plurality of radiation generation devices each having a radiation generation unit, in which each radiation generation unit includes a single electron emission source paired with a single anode 7. The radioactive ray generating apparatus described in any one of the first to fourth exemplary embodiments of the first invention can be used as the radiation generation device that includes the radiation generation unit according to the present exemplary embodiment. As illustrated in FIG. 8, one envelope and a plurality of radiation generation units cooperatively constitute a vacuum sealing structure for the multiple-type radioactive ray generating apparatus 26. Further, the plurality of radiation generation units can be disposed linearly or two-dimensionally.

Sixth Exemplary Embodiment

Figure 9:
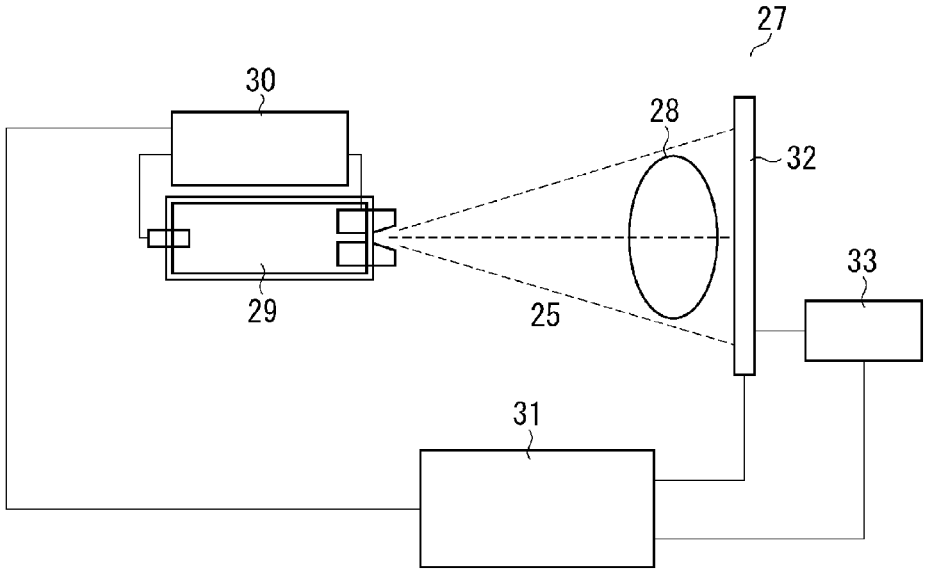
FIG. 9 illustrates an example configuration of a radioactive ray imaging system that includes the radioactive ray generating apparatus according to the first invention.

A radioactive ray imaging system according to a sixth exemplary embodiment of the first invention uses the above-described radioactive ray generating apparatus according to the first invention. FIG. 9 illustrates an example configuration of the radioactive ray imaging system according to the present exemplary embodiment.

A radioactive ray imaging system 27 according to the present exemplary embodiment includes a radioactive ray generating apparatus 29, a control power source 30 that drives the radioactive ray generating apparatus 29, a radiation sensor 32, and a computer 31 that can display captured image data and analyze images, which are systematically combined with each other. The radioactive ray generating apparatus described in any one of the first to fifth exemplary embodiments of the first invention can be used as the radioactive ray generating apparatus 29.

When the control power source 30 drives the radioactive ray generating apparatus 29, the radioactive ray generating apparatus 29 generates radioactive rays 25. The control power source 30 applies a voltage to a circuit that applies a higher voltage between cathode-anode terminals, the electron emission source, the grid electrode, and the focusing electrode. A radiation sensor power source 33 can control the radiation sensor 32. The radiation sensor 32 can acquire image capturing information of a test piece 28 located between the radiation sensor 32 and the radioactive ray generating apparatus 29. The computer 31 can display the acquired image capturing information. The computer 31 includes the control power source for driving the radioactive ray generating apparatus 29, the control power source for driving the radiation sensor 32, and a display unit that can be used to display captured image data and analyze images. The radioactive ray generating apparatus 29 and the radiation sensor 32 can be cooperatively controlled considering a target image to be captured, e.g., a still image, a moving image, or considering the difference in an image capturing position. The computer 31 can analyze a captured image and compare the captured image with previous data.

Exemplary Embodiment of the Second Invention

A radioactive ray generating apparatus according to an exemplary embodiment of a second invention is described below in detail with reference to attached drawings. However, materials, dimensions, shapes, and relative layout of constituent components described in the following exemplary embodiments are mere examples and are not intended to narrowly interpret the scope of the present invention unless they are mentioned specifically.

Figure 10:
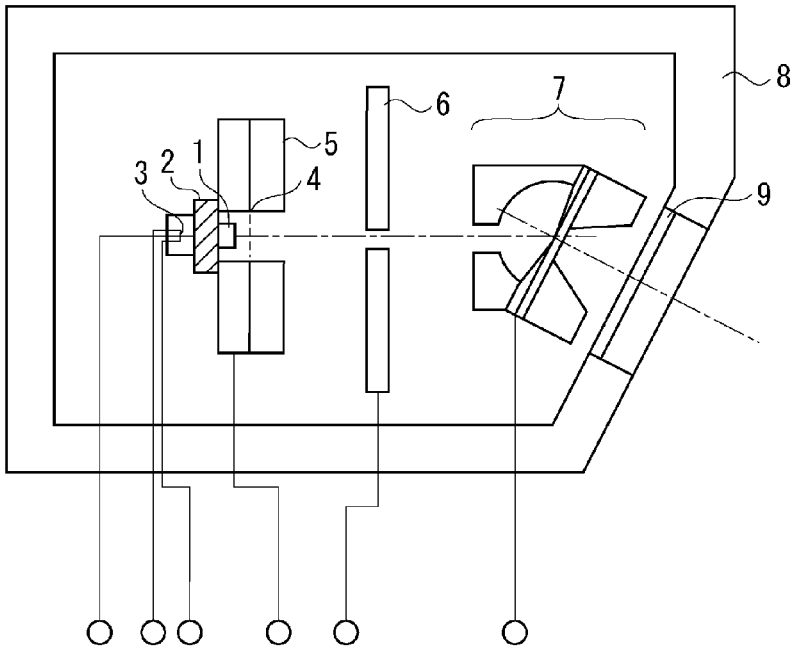
FIG. 10 illustrates a cross-sectional configuration of a radioactive ray generating apparatus according to the second invention.

An example configuration of the radioactive ray generating apparatus according to the second invention is described below with reference to FIG. 10. FIG. 10 illustrates a cross-sectional configuration of the radioactive ray generating apparatus.

The radioactive ray generating apparatus according to the second invention includes an electron emission source 1 that can emit electrons. Either a cold cathode or a hot cathode can be used as a cathode of the electron emission source 1. However, when the electron emission source is incorporated in the radioactive ray generating apparatus, it is desired to use an impregnated cathode (hot cathode) because large electric current can be stably extracted even in an environment where the degree of vacuum is relatively high. The electron emission source 1 is integrated with an insulation member 2.

A heater 3 is positioned in the vicinity of the cathode. When electric power is supplied to the heater 3, temperature of the cathode rises and electrons are emitted from the cathode.

A grid electrode 4 is an electrode to which a predetermined voltage is applied to extract electrons generated from the electron emission source 1 (i.e., the cathode) into a vacuum. The grid electrode 4 and the electron emission source 1 are spaced from each other with a predetermined distance between them. To realize the above-described layout, the insulation member 2 is integrated with the electron emission source 1 and is positioned to abut against the grid electrode support member 5. The grid electrode 4 is spaced from the cathode via a predetermined clearance (e.g., several hundred micrometers) due to the intervention of the grid electrode support member 5. The grid electrode 4 has a shape, a bore diameter, and an aperture ratio that can be determined considering exhaust conductance in the vicinity of the cathode to let the electric current efficiently reach the target. For example, a tungsten mesh having a wire diameter of approximately 50 micrometer can be used to form the grid electrode 4.

A focusing electrode 6 is provided to control a focal diameter of an electron beam on a target plane when the grid electrode 4 extracts electrons from the cathode. The focal diameter determines a circular focus area on the target plane. It is usual that a voltage of several hundred volts to several thousand volts is applied to the focusing electrode 6 to adjust the focal diameter. Alternatively, the focusing electrode 6 can be omitted if an appropriate lens effect capable of focusing the electron beam can be realized by applying a predetermined voltage to the grid electrode support member 5.

An anode 7 includes a target 16 (transmission-type target) capable of generating radioactive rays when an electron beam of a predetermined energy level collides against the target 16. A voltage (several tens to several hundreds kV) is applied to the anode 7. The anode 7 functions as a positive electrode that corresponds to a cathode (negative electrode) of the electron emission source 1. When an electron beam is generated by the electron emission source 1, the electron beam is extracted by the grid electrode 4. Then, the electron beam is directed toward a focus area on the anode 7 by the focusing electrode 6. The electron beam is accelerated by the voltage applied to the anode 7, collides against the target 16, so that radioactive rays is generated. The radioactive rays generated from the target 16 can be extracted to the outside of an envelope 8 (i.e., vacuum chamber) via a radiation transmission window 9.

Figure 11:
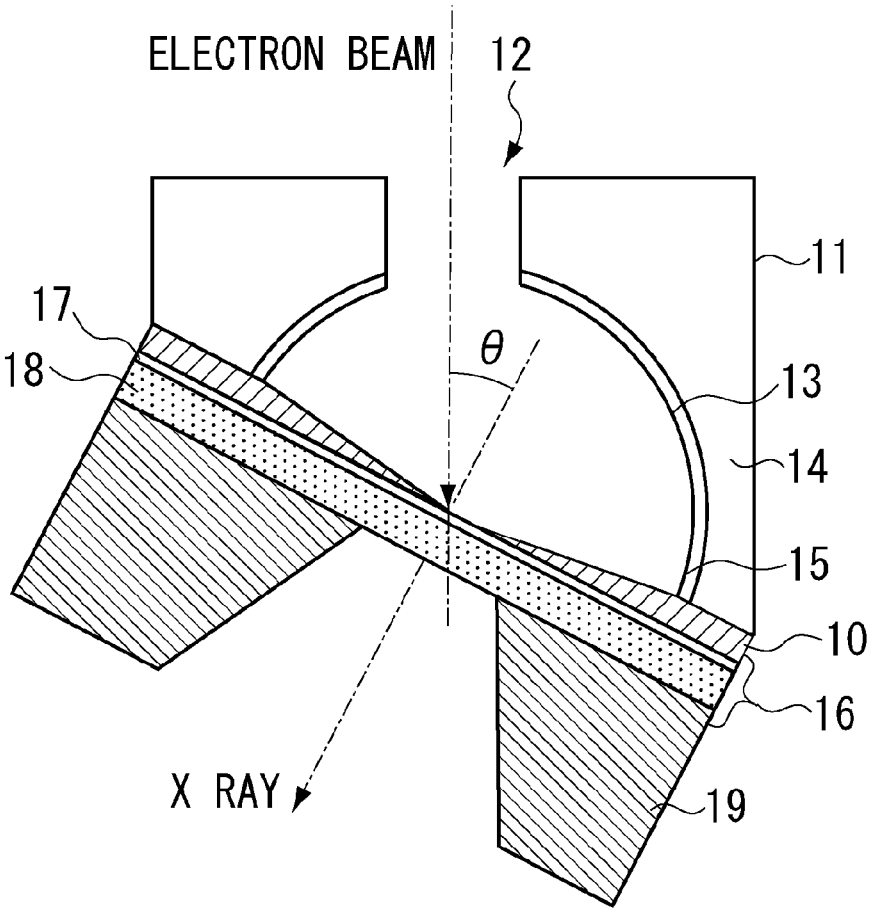
FIG. 11 illustrates a cross-sectional configuration of an anode according to a first exemplary embodiment and a second exemplary embodiment of the second invention.

A configuration of the anode 7 is described below in more detail with reference to FIG. 11. FIG. 11 is a cross-sectional view illustrating an example configuration of the anode 7.

Electrons having been emitted from the electron emission source 1 and accelerated by an electric field formed by the anode 7 collide against the target 16 at a predetermined incident angle. A part of the electrons can be used to generate radioactive rays from a plane opposed to the incidence plane of the electrons. Another part of the electrons become reflection electrons when reflected toward the incidence plane of the electrons. The target 16 includes a target film 17 and a transmissive substrate 18. The target film 17 can generate radioactive rays when an electron collides against the target film 17. The transmissive substrate 18 can transmit radioactive rays generated from the target film 17. A metallic material containing tungsten, molybdenum, chromium, copper, cobalt, iron, rhodium, rhenium, or an alloy thereof can be used as a thin film that forms the target film 17. A physical film formation, such as spattering, is employable to form the target film 17 having a compact film structure. The electron beam penetration depth (e.g., an X-ray generation area) is variable depending on the acceleration voltage. Accordingly, an optimum film thickness of the target film 17 to be formed on the transmissive substrate 18 may change, but it is in a range from several micrometers to several ten micrometers if the acceleration voltage is approximately a hundred kV.

A material, e.g., silicon carbide, that is excellent in heat conductivity and radiation transmissivity can be used as a material that constitutes the transmissive substrate 18. The target 16 is disposed along a plane that is inclined at an angle theta relative to the incidence direction of the electron beam. The above-described inclined arrangement is useful in that reflection electrons can be efficiently used to improve the efficiency in generation of radioactive rays. A desired value of the inclined angle theta is in a range from 20 degrees (angle) to 40 degrees (angle).

A focus regulating member 10 is assembled with the target 16. The focus regulating member 10 can regulate the focal point of radioactive rays and has a cross-sectional shape gradually decreasing from the electron emission source 1 toward the target 16. The focus regulating member 10 is bonded to a surface of the target 16. Further, the focus regulating member 10 has an aperture which has a truncated cone shape and its upper surface on the target 16. When electrons pass through the aperture of the focus regulating member 10 and collide against the target 16, the target 16 generates radioactive rays. The focus regulating member 10 has a function of regulating the focal point of radioactive rays by the aperture diameter seen from a radiation extraction plane side, and a function of shielding radioactive rays generated from an area other than the focal point (a function as a radiation shielding member). More specifically, an area on the target 16 that corresponds to the upper surface of the truncated cone of the aperture becomes the focus area, and the electrons do not collide against a surface of the target 16 but the focus area. In other words, since the aperture has the truncated cone shape, the focus regulating member 10 can provide a function of efficiently directing the reflection electrons from the target film 17 toward the electron reflection member 11 without shielding the reflection electron beam.

According to the example illustrated in FIG. 11, the electron reflection member 11 is disposed by bonding to the focus regulating member 10 which is positioned on an electron beam incidence plane side. When the focus regulating member 10 is positioned on the radiation extraction plane side, the electron reflection member 11 is directly bonded to the target 16. In this case, the focus regulating member 10 includes an aperture which has a truncated cone shape and an upper surface thereof is positioned on a surface of the target 16 at the radiation extraction plane side. Even when the above-described modified configuration is employed, it is feasible to extract only the radioactive rays generated from the focus area while preventing an area other than the focal point from generating radioactive rays. In addition, the inclined angle or the center angle of the truncated cone can regulate the angle of radioactive rays to be irradiated.

The electron reflection member 11 includes a base material 14 and an electron reflection film 15 which is capable of reflecting electrons and is formed on a surface of the base material 14. The base material 14 contains copper because of excellent heat conductivity thereof. A metallic material having a larger atomic number, such as tantalum, tungsten, rhenium, osmium, iridium, platinum, gold, or an alloy thereof can be used as a thin film that forms the electron reflection film 15.

The electron reflection member 11 includes an electron incidence opening 12 and an electron reflection surface 13 formed by the electron reflection film 15. Electrons can reach the target 16 through the electron incidence opening 12. When reflection electrons are generated from the focus area of the target 16, the electron reflection surface 13 guides the reflection electrons toward the focus area again. In general, when a reflection electron beam is generated from a target plane, the intensity of the generated reflection electron beam can be maximized when an incident angle becomes equal to a reflection angle. Therefore, it is desired that the electron reflection film 15 is arranged to be perpendicular to the direction that corresponds to the above-described critical condition.

According to the above-described arrangement, an electron beam emitted from the electron emission source 1 can pass through the electron incidence opening 12 and reach the target 16. The generated reflection electrons are reflected by the electron reflection surface 13 and reach the target 16 again. Further, by using reflection electrons whose energy loss by the reflection at the target film 17 is small and which maintain relatively higher kinetic energy to generate radioactive rays from the electron reflection surface 13 and guiding the generated radioactive rays toward the focus area, the efficiency in generation of radioactive rays can be improved.

The reflection electrons from the target 16 collide against the electron reflection member 11 and reflect. The reflection electrons having reached the electron reflection member 11 are party reflected by the electron reflection surface 13 of the electron reflection member 11 to travel as reflection electrons, then reach the focus area of the target 16.

The above-described arrangement according to the present exemplary embodiment can improve effective X-ray generation efficiency because reflection electrons are effectively used, so that the heat load of the cathode can be greatly reduced. Thus, the radioactive ray generating apparatus according to the present exemplary embodiment can maintain uniform and stable characteristics for a long time. Further, the focus regulating member 10 can prevent radioactive rays from generating from an area other than the focal point. Thus, the arrangement according to the present exemplary embodiment can prevent the contrast of a radiation image from deteriorating and eliminate unnecessary exposure by radioactive rays that do not contribute to generation of an image. As described above, the arrangement according to the present exemplary embodiment can realize a high-performance and low-invasion radioactive ray generating apparatus. Furthermore, the focus regulating member 10 can absorb or reflect an electron beam traveling toward an area other than the focus area of the target. The electron reflection member 11 can reflect or absorb the reflection electrons reflected by the target. In this manner, the focus regulating member 10 and the electron reflection member 11 can suppress adverse influences of heat generated by the target.

Instead of the above-described electron reflection member 11, an electric field may be provided to cause electrons reflected by the target 16 to travel toward the target 16 again. However, a potential difference that can provide energy equivalent to the energy having been given to the electrons between the anode and the cathode is required to cause electrons accelerated between the anode and the cathode to return the cathode (i.e., the target 16). Therefore, a very high voltage is required and it is difficult to perform control to accurately guide the electrons into the target 16. In the radioactive ray generating apparatus according to the present exemplary embodiment, reflection electrons physically collide and are reflected. Thus, the reflection electrons can be guided toward the target again without relying on the above-described electric field based control.

Exemplary Embodiment 1

A first exemplary embodiment of the second invention is an example of the configuration described in the above-described exemplary embodiment is described below with reference to FIG. 10 and FIG. 11. An impregnated cathode assembly that is manufactured by TOKYO CATHODE LABORATORY CO., LTD can be used as the electron emission source 1 illustrated in FIG. 10. Although a heating operation is required to activate the impregnated cathode, the impregnated cathode can stably supply large electric current even in an environment where the degree of vacuum is relatively high and can be preferably used as an electron emission source for a radioactive ray tube.

The cathode has a columnar body in which an emitter (electron emission portion) is impregnated. The cathode is fixed, by brazing, to a cap that is fixed to an upper edge of a cylindrical sleeve. A heater 3 is attached to a predetermined portion in the sleeve. When electric power is supplied to the heater 3, the cathode is heated and generates thermal electrons.

The temperature of the cathode can be easily increased up to 900 to 1000 degrees (Celsius) by supplying electric power of approximately 1 W to the heater 3, which is positioned in the vicinity of the cathode. For example, if the cathode temperature is maintained at 900 degrees (Celsius), electric current of approximately 1 mA can be extracted from the cathode when an electric field of approximately 20 V/micrometer is applied between the cathode-grid electrodes.

The target 16 includes a transmissive substrate 18 constituted by a silicon carbide substrate (0.5 mm in thickness) and a target film 17 which is constituted by a tungsten film (5 micrometer in thickness) and formed on the transmissive substrate 18. The target 16 is sandwiched between a shielding member 19 made of tantalum and a focus regulating member 10. A normal line of the target 16 and an axis of an incidence electron beam are arranged to form an angle of 20 degrees (angle).

The focus regulating member 10 contains tantalum and has a plate thickness of 1.5 mm. The focus regulating member 10 has an aperture having a truncated cone shape. A diameter of the aperture of the focus regulating member 10 at a side where the focus regulating member 10 is bonded to the target film 17, that is an effective focal point of radioactive rays, is 1 mm. Further, a diameter of the aperture of the focus regulating member 10 at the other side where the focus regulating member 10 is bonded to the electron reflection member 11 is 5 mm. The center of the aperture of the focus regulating member 10 coincides, at the target film 17 side, with the axis of the incidence electron beam.

The electron reflection member 11 includes a semi-spherical electron reflection surface 13 (6.7 mm in diameter) that surrounds the focus area of the target 16. The center of the electron reflection surface 13 coincides with the center of the aperture of the focus regulating member 10, which is positioned on the target film 17 side. More specifically, the center of the electron reflection surface 13 coincides with the focus area. According to this structure, the electron reflection surface 13 prevents electrons from leaking from an area other than the electron incidence opening 12. Further, the electron reflection member 11 includes the electron incidence opening 12 having a cylindrical shape (2 mm in diameter) whose center coincides with the axis of the incidence electron beam. Further, an electron reflection film 15 is formed on the electron reflection surface 13. The electron reflection film 15 contains tungsten and has a thickness of 5 micrometer. Similar to the grid electrode 4, material subjected to a degassing treatment, such as hydrogen annealing or vacuum fusion, can be suitably used for the electron reflection film 15. The above-described constituent components of the radioactive ray tube are disposed in an envelope 8 (i.e., vacuum chamber) so as to constitute a radioactive ray generating apparatus. The envelope 8 includes a radiation transmission window 9. The radioactive ray generating apparatus according to the present exemplary embodiment includes terminals that are dedicated to external drive controls for the radioactive ray tube. Each terminal is connected to a control power source. The radioactive ray tube can be controlled according to an input from the control power source, so that the radioactive ray tube can function as an X-ray generation apparatus that generates radioactive rays. In this case, the control power source and a central processing unit (CPU) that determines an input pattern of the control power source serves as a control unit of the radioactive ray tube.

A radioactive ray tube that does not include any electron reflection member was prepared as a comparative example and compared with the radioactive ray tube according to the present exemplary embodiment with respect to the radiation intensity that corresponds to a predetermined tube electric current. Compared with the comparative example, the radioactive ray tube according to the present exemplary embodiment could increase the radiation intensity and improve the X-ray generation efficiency.

Exemplary Embodiment 2

A radioactive ray generating apparatus according to a second exemplary embodiment of the second invention is described below with reference to FIG. 11. The radioactive ray generating apparatus according to the second exemplary embodiment includes constituent components that are similar to those described in the first exemplary embodiment of the second invention, although the descriptions thereof are not repeated. The radioactive ray generating apparatus according to the present exemplary embodiment is characterized in that the electron reflection surface 13 of the electron reflection member 11 includes a plane perpendicular to the direction that can maximize the intensity of a reflection electron beam. More specifically, the electron reflection surface 13 includes a plane perpendicular to the direction that can equalize the incident angle of an electron beam relative to the target 16 with the reflection angle of the electron beam. According to this arrangement, electrons reflected to the direction in which the incident angle becomes equal to the reflection angle can be easily guided to the target 16. Thus, the radioactive ray generating apparatus according to the present exemplary embodiment can improve the efficiency in generation of radioactive rays. Further, the radioactive ray generating apparatus according to the present exemplary embodiment can reduce the manufacturing cost of parts because it is only required to adjust the plane perpendicular to the direction that can maximize the intensity of a reflection electron beam.

Exemplary Embodiment 3

A radioactive ray tube according to a third exemplary embodiment of the second invention is described below with reference to FIG. 12. The radioactive ray tube according to the third exemplary embodiment includes constituent components similar to those described in the first exemplary embodiment of the second invention, although the descriptions thereof are not repeated. The radioactive ray tube according to the present exemplary embodiment is characterized in that a focus regulating member 10 is positioned on a radiation extraction plane side of the target 16. Further, the focus regulating member 10 has a function as a radiation shielding member.

Figure 12:
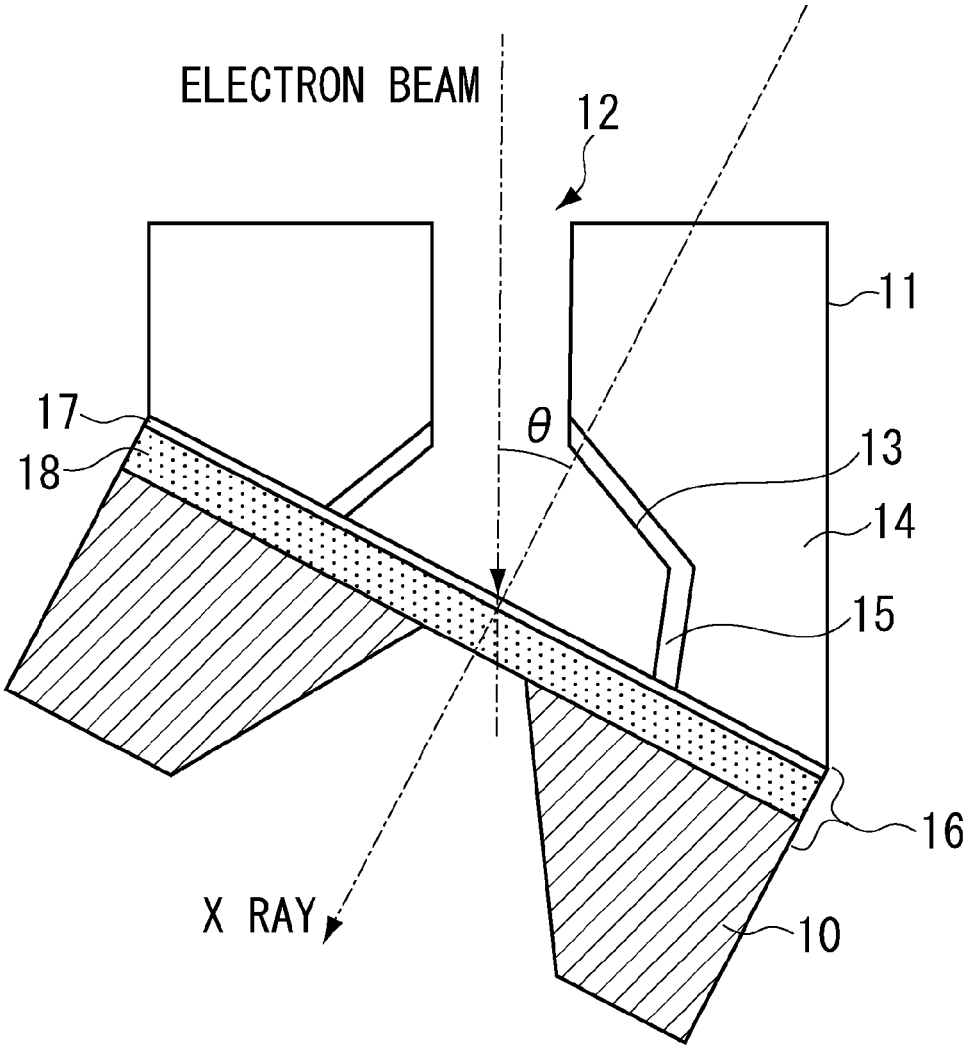
FIG. 12 illustrates a cross-sectional configuration of an anode according to a third exemplary embodiment of the second invention.

As illustrated in FIG. 12, the focus regulating member 10 is positioned on the radiation extraction plane side of the target 16 in such a way that the normal line passing through the aperture center of the focus regulating member 10 intersects the axis of an incidence electron beam on the target film 17. The heat load of the target 16 according to the present exemplary embodiment becomes larger than that of the first exemplary embodiment of the second invention because a metallic member is disposed only on one side of the target 16 in the vicinity of the focal point of the target 16. In an X-ray tube having the configuration according to the present exemplary embodiment, the intensity of radioactive rays increases compared to a radioactive ray generating apparatus that does not include any electron reflection member.

As another exemplary embodiment of the second invention, a plurality of electron emission sources can be disposed in the envelope 8 (i.e., vacuum chamber). In this case, the plurality of electron emission sources can cooperatively operate as an X-ray source capable of uniformly generating X-rays in a wide area. Further, it is useful to configure each electron emission source to independently perform drive control. In this case, radioactive rays can be emitted toward a desired range.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2010-037668 filed Feb. 23, 2010, No. 2010-275622 filed Dec. 10, 2010, and No. 2010-278363 filed Dec. 14, 2010, which are hereby incorporated by reference herein in their entirety.

The invention claimed is:

1. A x-ray generating apparatus comprising:

a plurality of electron emission sources aligned along a certain direction;

a plurality of targets configured to receive an electron beam emitted from each of the plurality of electron emission sources and to generate x-rays, each one of the plurality of targets including a target film and a transmissive substrate, the target film and the transmissive substrate arranged in this order with respect to a corresponding electron emission source such that a x-ray generated from the target film transmits through the transmissive substrate; and a shielding member having a plurality of apertures, each aperture configured to hold a corresponding one of the targets having the target film and the transmissive substrate, wherein each aperture is configured to shield a part of the x-ray emitted from a corresponding target, and wherein any adjacent two of the plurality of transmissive substrates are connected via the shielding member such that any adjacent two of the plurality of targets are connected via the shielding member and wherein the shielding member acts as a thermal transfer path.

2. The x-ray generating apparatus according to claim 1, wherein the target is made of a metallic member having an atomic number equal to or greater than 26.

3. A x-ray imaging system comprising a combination of the x-ray generating apparatus defined in claim 1, a control power source that drives the x-ray generating apparatus, a radiation sensor, and a computer that displays captured image data and analyzes images.

4. The x-ray generating apparatus according to claim 1, wherein at least a part of the shielding member is brought into contact with a cooling medium.

5. The x-ray generating apparatus according to claim 4, wherein the cooling medium is air or electric insulation oil.

6. The x-ray generating apparatus according to claim 1, wherein the transmissive substrate is diamond.

7. The x-ray generating apparatus according to claim 1, wherein the shielding member includes a forward shielding member and a backward shielding member each including an aperture.

8. The x-ray generating apparatus according to claim 7, wherein the backward shielding member, the target, and the forward shielding member are sequentially positioned in this order from a side adjacent to the plurality of electron emission sources.

9. The x-ray generating apparatus according to claim 7, wherein the forward shielding member is thermally connected to the plurality of targets.

10. The x-ray generating apparatus according to claim 1, wherein the any adjacent two of the plurality of the targets are thermally connected.

11. The x-ray generating apparatus according to claim 1, wherein the plurality of targets is aligned along an arrangement of the plurality of electron emitting sources.

12. The x-ray generating apparatus according to claim 11, wherein the plurality of targets is arranged in a linear or two-dimensional manner.

13. The x-ray generating apparatus according to claim 1, the apparatus further comprising an envelope enclosing the plurality of electron emission sources, wherein the envelope, the plurality of targets and the shielding member cooperatively constitute a vacuum sealing structure.

14. The x-ray generating apparatus according to claim 1, wherein each transmissive substrate has a thickness in a range of 0.1 to 2 mm and contains one or more of diamond, silicon nitride, silicon carbide, aluminum carbide, aluminum nitride, and beryllium.

15. A x-ray generating apparatus comprising:

a cathode includes an electron source array having a plurality of electron emission sources aligned along a certain direction, and an anode includes a target array having a plurality of transmissive targets arranged along the electron source array and a multi-tubular shielding member, wherein each of the transmissive targets includes a target film and a transmissive substrate supporting the target film, wherein the multi-tubular shielding member includes a plurality of apertures, each aperture configured to hold a corresponding one of the transmissive targets, and to attenuate an X-ray emitted from the corresponding one of the transmissive targets, wherein any adjacent two of the plurality of transmissive substrates are connected via the multi-tubular shielding member such that any adjacent two of the plurality of transmissive targets are thermally connected via the multi-tubular shielding member wherein the x-ray is emitted from the target film and passes through the transmissive substrate and the shielding member acts as a thermal transfer path.

16. The x-ray generating apparatus according to claim 15, the apparatus further comprising an envelope enclosing the electron emission sources array, wherein the envelope and the target array including the multi-tubular shielding member and the plurality of transmissive substrates cooperatively constitute a vacuum sealing structure.

17. The radioactive ray generating apparatus according to claim 15, wherein each transmissive substrate has a thickness in a range of 0.1 to 2 mm and contains one or more of diamond, silicon nitride, silicon carbide, aluminum carbide, aluminum nitride, and beryllium.

18. A radioactive ray generating apparatus comprising:

a plurality of electron emission sources aligned along a certain direction;

a plurality of targets configured to receive an electron beam emitted from each of the plurality of electron emission sources and to generate x-rays, each one of the plurality of targets including a target film and a transmissive substrate; and a shielding member having a plurality of apertures, each aperture configured to hold a corresponding one of the targets having the target film and the transmissive substrate, wherein each aperture is configured to shield a part of the x-ray emitted from a corresponding target, wherein any adjacent two of the plurality of transmissive substrates are connected via the shielding member such that any adjacent two of the plurality of targets are connected via the shielding member, and wherein the target film, the transmissive substrate and the shielding member are arranged in this order with respect to a corresponding electron emission source such that a x-ray generated from the target film transmits through the transmissive substrate and passes through a corresponding aperture of the shielding member and wherein the shielding member acts as a thermal transfer path.

19. The radioactive ray generating apparatus according to claim 18, wherein at least a part of the shielding member is brought into contact with a cooling medium.

20. The radioactive ray generating apparatus according to claim 18, wherein the plurality of targets is aligned along an arrangement of the plurality of electron emitting sources.

* * * * *